US007455946B2

(12) United States Patent
Yabe et al.

(10) Patent No.: US 7,455,946 B2
(45) Date of Patent: Nov. 25, 2008

(54) TWO COMPONENT DEVELOPING AGENT

(75) Inventors: Naruo Yabe, Osaka (JP); Kouzou Teramoto, Osaka (JP); Norio Kubo, Osaka (JP); Takeo Mizobe, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 462 days.

(21) Appl. No.: 11/258,905

(22) Filed: Oct. 27, 2005

(65) Prior Publication Data

US 2007/0099104 A1 May 3, 2007

(51) Int. Cl.
*G03G 9/00* (2006.01)

(52) U.S. Cl. ..... 430/111.35

(58) Field of Classification Search ..... 430/111.35
See application file for complete search history.

(56) References Cited

U.S. PATENT DOCUMENTS 4,571,372 A * 2/1986 Urawa et al. ..... 430/122.2
4,791,041 A * 12/1988 Aoki et al. ..... 430/111.35
4,868,083 A * 9/1989 Nagatsuka et al. ..... 430/111.35
4,965,160 A * 10/1990 Nagatsuka et al. ..... 430/111.35
5,665,507 A * 9/1997 Takagi et al. ..... 430/111.35

* cited by examiner

*Primary Examiner*—Mark A Chapman
(74) *Attorney, Agent, or Firm*—Global IP Counselors, LLP

(57) ABSTRACT

A two-component developing agent retained on the periphery surface of a magnetic roller 11 and a development roller 12 are brought in contact with each other, the nonmagnetic toner in the two-component developing agent is electrostatically adhered to the periphery surface of the development roller 12, and the nonmagnetic toner on the development roller 12 is sprayed on the periphery surface of a photosensitive drum 13, thereby causing an image of an electrostatic latent image to appear on the photosensitive drum 13 as a toner image. The two-component developing agent for an image forming device thus configured comprises a nonmagnetic toner comprising color particles, and a magnetic carrier, wherein the magnetic carrier has a resin coating layer on the magnetic particle surface, and the critical surface tension of this resin coating layer is 25 dyn/cm or less.

6 Claims, 1 Drawing Sheet

TWO COMPONENT DEVELOPING AGENT

FIELD OF THE INVENTION

The present invention relates to a two-component developing agent used in development process by the hybrid development method.

BACKGROUND INFORMATION

Image forming devices such as electrostatic photocopiers, laser beam printers, and plain paper facsimiles use, as a method for developing an electrostatic latent image on an image retaining body such as a photosensitive drum, a two-component developing method using a two-component developing agent comprising a magnetic carrier and nonmagnetic toner, and a one-component developing method using a one component developer comprising only toner.

The two-component developing method entails such problems as a carrier moving on a photosensitive drum, causing transfer defects, and the carrier further moving on transfer paper, causing scratches on a fuser roller of a fuser device. On the other hand, the one-component developing method often causes charging of toner by friction, leading to the problem of image defects such as fog frequently occurring due to toner charging defects.

Thus, as a development method to resolve these problems, a so-called hybrid development method has been proposed. The hybrid development method is a development method such that a two-component developing agent comprising nonmagnetic toner and a magnetic carrier is maintained on a magnetic roller periphery surface, and the two-component developing agent is brought in contact with a development roller periphery surface to form a toner layer consisting only of the nonmagnetic toner on the development roller, and the toner layer is sprayed on an electrostatic latent image on a photosensitive drum, thereby executing the development. Because this development process is executed when the development roller and photosensitive drum are in a non-contact state, it is advantageous in terms of inhibiting degradation of image quality.

In this hybrid development method, regardless of the coverage of the formed image, the supply of toner from the magnetic roller to the development roller is always executed across the entire periphery surface of the development roller, and further, toner not consumed by the development process and remaining on the development roller is usually removed by an electrical method such as applying a reverse bias voltage. Alternatively, a conventional development device may be configured so that toner not consumed by the development process and remaining on the development roller is removed by a physical method employing toner release means disposed downstream in the development roller rotation direction.

Further, in a different prior art, there is a hybrid development method using as a development device that removes nonmagnetic toner remaining on a development roller without application of a large mechanical force thereupon, thereby inhibiting occurrence of ghosting, wherein a form factor used for a magnetic carrier is 130 or more. Form factor is a value indicating particle shape and surface conditions, and is calculated by the following formula: [(carrier perimeter)$^2$/(projected area of the carrier )×(¼)×100]. The degree of projections and recesses on a particle surface is represented by this form factor, and a carrier having a form factor of, for example, 130 or more has a large degree of unevenness, and indicates a nonspherical carrier.

In a hybrid development method, as described above, regardless of the coverage of a formed image, supply of toner from the magnetic roller to the development roller is always executed across the entire periphery surface of the development roller, and toner not consumed by the development process and remaining on the development roller is removed by an electrical method such as application of a reverse bias voltage. Repeatedly execution of this removal operation causes magnetic carrier to be contaminated with fine powder toner (so-called toner spent) and by free external additives, causing the problem of degraded magnetic carrier charging properties. Such degradation of magnetic carrier occurs particularly when an image with low coverage is repeatedly developed, causing toner charging defects and the problem of low-charge toner scattering within a development apparatus (toner scattering).

Further, as in the former prior art described above, when toner release means is pressed against the development roller and toner remaining after the development processing is removed, because toner release means is always pressed thereagainst, the development roller may wear, and the invention is not appropriate for uses requiring device durability.

Further, because in the hybrid development method, each time image formation is executed, a toner layer is formed on the development roller by a magnetic brush on the magnetic roller comprising a magnetic carrier and nonmagnetic toner, and after development, the toner layer remaining on the development roller is removed by the magnetic brush, the opportunities for magnetic carrier and nonmagnetic toner to be in contact increase considerably when compared to the case of a conventional two-component developing method, and replacement of the nonmagnetic toner retained by the magnetic carrier has to be performed more often. Therefore, with hybrid development, problems such as a large amount of toner spent, described above, and the peeling off the coating layer from the magnetic carrier surface easily occur.

Further, as in the second prior art described above, because when a nonspherical carrier having greater surface projections and recesses is used as a magnetic carrier in a two-component developing agent, the contact ratio between magnetic carriers increases, and sufficient charge can be applied, reaching the magnetic carrier at the magnetic brush tip, allowing a greater electric field to work in order to move the nonmagnetic toner between the development roller and magnetic roller, enabling prevention of ghosting. However, because the magnetic carrier has a nonspherical shape and has an uneven surface, fluidity of the two-component developing agent degrades, entailing new problems such as increase of toner spent through repetition of the image forming process, and accelerated peeling of the magnetic carrier coating layer.

Thus, it is an object of the present invention to provide a two-component developing agent used for image formation in a hybrid development method and capable of forming an image while preventing degradation of a magnetic carrier and consistently forming a high-quality image.

SUMMARY OF THE INVENTION

The present invention, in order to achieve the above object, provides:

(1) a two-component developing agent used in an image forming device comprising a magnetic roller, a development roller, and a photosensitive drum for retaining an electrostatic latent image on the periphery surface thereof, and configured so that a two-component developing agent comprising nonmagnetic toner and a magnetic carrier is retained on the magnetic roller periphery surface, the two-component developing agent retained on the magnetic roller and the development roller are brought in contact with each other, the nonmagnetic toner electrostatically adheres to the development roller periphery surface, and the nonmagnetic toner on the development roller is sprayed on the photosensitive drum periphery surface, so that the electrostatic latent image on the photosensitive drum appears as a toner image, wherein the nonmagnetic toner has color particles and a surface treatment agent, the magnetic carrier has magnetic particles and a resin coating layer provided on the surface thereof, and the critical surface tension of the resin coating layer is 25 dyn/cm or less;

(2) a two-component developing agent according to the above (1), wherein the resin coating layer comprises at least one resin selected from a group comprising a silicone resin, fluorocarbon resin, and polyamide resin; and (3) a two-component developing agent according to either of the above (1) or (2), wherein the nonmagnetic toner has color particles and a surface treatment agent, the containing ratio of the color particles having a particle diameter of no more than 2.0 μm is 10% or less of the total number of color particles, and the average degree of circularity of the color particles is 0.925 or more.

In the present invention, the critical surface tension of the resin coating layer on the magnetic carrier surface is a value inherent to a resin material forming a resin coating layer. The resin material to be measured is applied to a flat plate and processed under the same conditions as manufacturing a magnetic carrier to form a resin film, and on at test piece of the resin film thus obtained, the contact angles of pure water, methylene iodide and a-bromonaphthalene are respectively measured, and based on these contact angle measurements, the critical surface tension (dyn/cm) is calculated by the Zisman method.

In the present invention, the particle diameter of the color particles was calculated based on image analysis results by image analyzing means such as a flow type particle image analyzer; particle diameter indicates circular diameter of an individual color particle. More specifically, the particle diameter of color particles can be obtained by finding a circle having an area equivalent to the projected surface of one color particle shown on the analysis image and calculating the diameter of such a circle. Further, the containing ratio (based on number of particles) of color particles having a particle diameter of no more than 2.0 μm with respect to the total number of color particles can be calculated based on the particle diameter (diameter equivalent to a circle) analysis results for individual color particles.

In the present invention, degree of circularity of color particles was calculated based on analysis results of images of individual color particles by image analyzing means such as a flow type particle image analyzer. More specifically, the degree of circularity of color particles is calculated by seeking a circle with the same area as the projected surface of an individual particle shown on the analysis image, and subtracting the circumference of the circle from the length of the periphery of the projected surface. The closer the degree of circularity of the color particles approaches 1, the closer the color particle shape approaches a spherical shape; conversely, the more the degree of circularity falls below 1, the greater the flatness of the color particles. The average degree of circularity of color particles is the average of calculated degree of circularity of a sample (total number of 500-3000) of color particles randomly extracted.

The above particle diameter value is a value measured within the range of particle diameter of 0.6-400 μm using a flow type particle image analyzer (FPIA-2000 manufactured by Sysmex Corporation). Because the range in which particle size distribution can be measured by the above measuring device is the range of a particle diameter of 0.6-400 μm, the present invention concerns color particles having a particle diameter within the range of 0.6-400 μm. The same applies for average degree of circularity of color particles.

With the two-component developing agent of the present invention, adherence of color particles to a carrier surface is reduced, thereby preventing the degradation of carrier charging properties, and the occurrence of toner scatter.

DETAILED DESCRIPTION OF THE PREFERRED EMBODIMENTS

Figure 1:
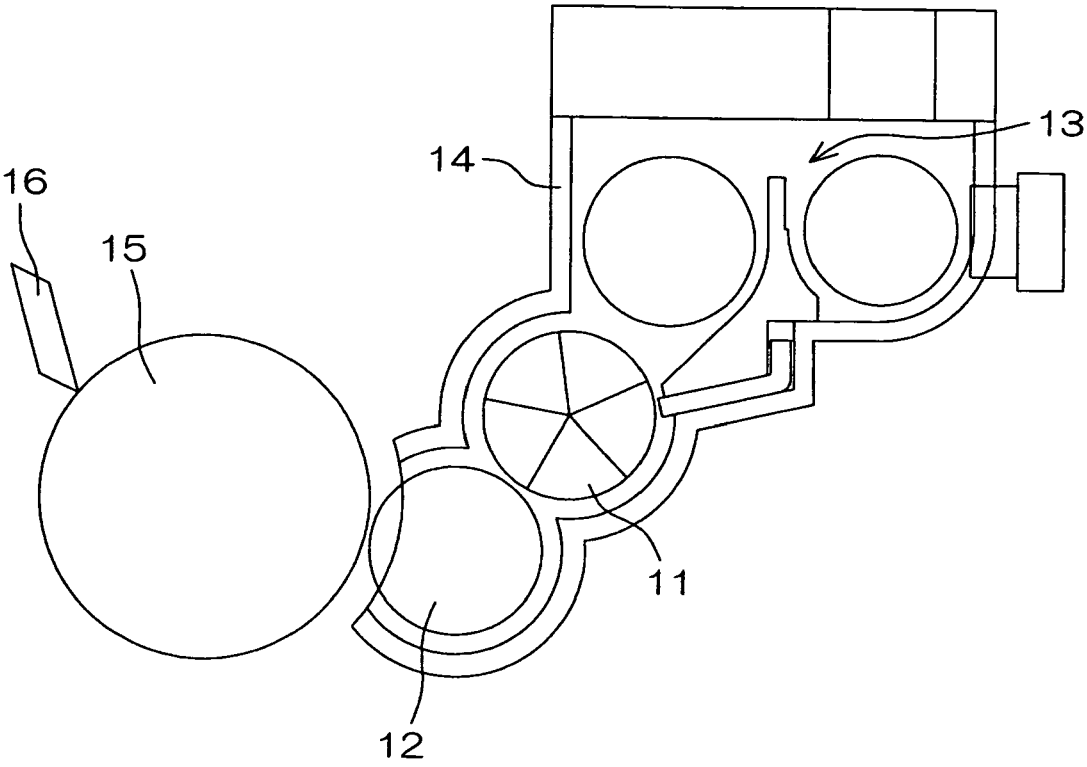
FIG. 1 is a schematic view showing an embodiment of an image forming device relating to the present invention.

Hereinbelow, an embodiment of the present invention will be explained in detail with reference to the annexed drawing.

The two-component developing agent of the present invention comprises nonmagnetic toner comprising color particles and a magnetic carrier.

The two-component developing agent of the present invention can include, as color particles constituting nonmagnetic toner, for example, color particles obtained by mixing in a binder resin, a colorant and, if necessary, a charge control agent, offset inhibitor, and stabilizer, fusing, kneading, and grinding the same (coarse grinding, fine grinding) and classified. The color particles are not limited to the color particles produced by the above described grinding method. Alternatively, they may be formed by a suspension polymerization method.

Mills used for finely grinding coarsely ground color particles include, for example, "TurboMill" (product name) produced by TurboMill K.K., "Fine Mill" (product name) produced by Nippon Pneumatic Mfg. Co., Ltd., "Inomizer" (product name) produced by Hosokawa Micron K.K., "Super Rotor" (product name) produced by Japan Engineering Co., Ltd., and "Cebros" (product name) and "Cryptron" (product name) produced by Kawasaki Heavy Industries, Ltd., but no particular limitations are placed with respect thereto. Further, after the grinding process is performed on the color particles, a fine grinding process may be executed for a given period of time using a high-speed stirring type mixer such as a Henschel Mixer (produced by Mitsui Mining Co., Ltd).

While no particular limitations are placed with respect to particle diameter of the color particles, it is preferable that the predominant particle diameter in terms of volume be 4-12 μm, and more preferably 6-10 μm.

In a hybrid development method, particularly when an image is repeatedly developed at a low coverage, on the development roller periphery surface, only on that portion on which the toner has been consumed by the development process, does highly charged toner accumulate and remain, such toner being difficult to remove by the above electrical method and not easily transferred to the photosensitive drum. In such a case, at time of the subsequent development processing, the image density of the surface portion on which the previous image was developed may lower, entailing the problem of a so-called ghost phenomenon in which a history of the previous development processing appears as a residual image.

Thus, in order to prevent occurrence of high-charge toner and thus prevent occurrence of the ghost phenomenon, it is preferable that the containing ratio of toner having a small particle diameter be reduced. More specifically, a preferable two-component developing agent of the present invention is configured so that the containing ratio of the color particles having a particle diameter of 2.0 μm or less is set at no more than 10% of the total number of the color particles. The containing ratio of the above based on the particle number is more preferably 8% or less.

Because fine color particles having a particle diameter of less than 2.0 μm have a large surface area per weight, electrical adherence can easily increase from high charging, and because of the small particle diameter, physical adherence is also strong. As a result, such fine color particles are difficult to separate from a development sleeve and magnetic carrier surface, and when the ratio of such particles contained in the color particles is high, the effects of removing toner on the development roller after development processing are insufficient, and the density of the toner layer formed on the development roller is lowered, leading to risk of the above ghost phenomenon. However, because the two-component developing agent of the present invention is configured so that there is a low containing ratio of fine color particles having a particle diameter of less than 2.0 μm, high charging of nonmagnetic toner is prevented, thereby reducing electrical and physical adherence. Therefore, with the two-component developing agent of the present invention, occurrence of the ghost phenomenon can be prevented.

The minimum value of the particle diameter of the color particles that can be found by the flow type particle image analyzer is roughly 0.6 μm in practice. In the present invention, among the color particles having a particle diameter of 2.0 μm or less, calculation of containing ratio based on particle number was carried out only with respect to particles having a particle diameter of 0.6 μm or more. However, in accordance with the gist of the present invention, it is preferable that there be a low containing ratio for color particles having a particle diameter of less than 0.6 μm as well.

Further, for the present invention, in consideration of the maximum value of color particle diameter that can be found by image analyzing means such as the flow type particle image analyzer, as a reference for calculation of the containing ratio of color particles having a particle diameter of 2.0 μm or less, the total number of color particles having a particle diameter within the range of 0.6-400 μm was used. However, because color particles having a large particle diameter cause degradation of image quality of a formed image, usually, it is preferable that no color particles having a particle diameter of more than 20 μm be included, or that the containing ratio of color particles having a particle diameter within the range of 0.6-400 μm with respect to the total number of particles be 1% or less in terms of number of particles.

To set the containing ratio of color particles having a particle diameter of 2.0 μm or less (based on particle number) among the color particles so as to satisfy the above range, it is sufficient to classify color particles to remove color particles having a particle diameter of 2.0 μm.

Further, it is preferable that the two-component developing agent of the present invention be configured so that the average degree of circularity of the color particles is 0.925 or more. The average degree of circularity of the above color particles is more preferably 0.940 or more.

Because when the average degree of circularity of color particles is 0.925 or more, the color particle shape is almost spherical, fluidity of nonmagnetic toner is enhanced and a toner layer having a uniform thickness is easily formed on the development roller, thereby improving the image quality of the formed image.

Further, the average degree of circularity of color particles is set at 0.925 or more, thereby inhibiting occurrence of the void phenomenon. Specifically, when a toner image appearing on the photosensitive drum is transferred to an intermediate transfer body, recording medium or the like, even if a transfer bias voltage is applied to electrically attract the nonmagnetic toner, if the physical adherence between the nonmagnetic toner and photosensitive drum is stronger, sufficient transfer cannot be achieved, leading to the risk of the so-called void phenomenon in which a toner image partially remains on the photosensitive drum. This void phenomenon becomes notable when color particles of nonmagnetic toner are irregularly shaped (i.e, when the degree of circularity is low). Thus, the two-component developing agent of the present invention, as described above, is configured so that the average degree of circularity of the color particles is a high value such as 0.925 or more, and physical adherence among nonmagnetic toner particles and between nonmagnetic toner and the photosensitive drum is inhibited, thereby inhibiting occurrence of the void phenomenon.

When the average degree of circularity of color particles is 1 or a value extremely close to 1, there is less unevenness on the color particle surfaces, giving rise to the likelihood that nonmagnetic toner remaining after the transfer step might slip past a cleaning blade at time of removal from the photosensitive drum. Therefore, for use in an image forming device in which cleaning means for removing remaining toner from the photosensitive drum is a cleaning blade, the average degree of circularity of color particles is preferably 0.925-0.980, and more preferably 0.940-0.980.

To set the average degree of circularity of color particles at 0.925 or more, it is only necessary to set grinding conditions as appropriate in such a way that, for example, grinding time for color particles is increased, a grinding step is repeated more than once, and so on.

Examples of a binder resins for forming color particles include an olefin polymer such as a styrene polymer, acrylic polymer, styrene-acrylic polymer, chlorinated polystyrene, polypropylene, and ionomer; a polyester resin, polyamide resin, polyurethane resin, epoxy resin, diallyl phthalate resin, silicone resin, ketone resin, polyvinyl butyral resin, phenol resin, rosin-modified phenolic resin, xylene resin, rosin-modified maleic acid resin, rosin ester and the like. Preferred binder resins among the above include a styrene polymer, styrene-acrylic polymer and polyester resin.

Examples of the above styrene polymers include not only a styrene homopolymer but also a copolymer of styrene and other monomer. Other monomers that can be compolymerized with styrene include, for example, p-chlorostyrene; vinylnaphthalene; ethylene unsaturated monoolefins such as ethylene, propylene, butylene, isobutylene and the like; halogenated vinyls such as vinyl chloride, vinyl bromide, vinyl fluoride and the like; vinyl esters such as vinyl acetate, propionic acid vinyl, benzoic acid vinyl, butyric acid vinyl and the like; acrylic esters such as methyl acrylate, ethyl acrylate, acrylic acid n-butyl, isobutyl acrylate, acrylic acid n-octyl, dodecyl acrylate, acrylic acid 2-chloroethyl, acrylic acid phenyl, α-chloromethyl acrylate and the like; methacrylic acid esters such as methyl methacrylate, ethyl methacrylate, butyl methacrylate and the like; other acrylic acid derivatives such as acrylonitrile, metacrylonitrile, acrylamide and the like; vinyl ethers such as vinyl methyl ether, vinyl isobutyl ether and the like; vinyl ketones such as vinyl methyl ketone, vinyl ethyl ketone, methyl isopropyl ketone and the like; and N-vinyl compounds such as N-vinyl pyrrole, N-vinyl carbazole, N-vinyl indole, N-vinyl pyrrolidone and the like. These monomers can be copolymerized with styrene either independently or by combining two or more kinds thereof.

Examples of polyester resins include a resin obtained by polycondensation of, for example, a polycarboxylic acid component and polyalcohol component.

Examples of polycarboxylic acid components include bivalent carboxylic acid such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid and the like; an alkyl ester or alkenyl ester of bivalent carboxylic acid such as n-butyl succinic acid, n-butenil succinic acid, isobutyl succinic acid, isobutenil succinic acid, n-octyl succinic acid, n-octenyl succinic acid, n-dodecyl succinic acid, n-dodecenylsuccinic acid, isododecyl succinic acid, isododecenylsuccinic acid and the like; and a carboxylic acid (trivalent or more) such as 1,2,4-benzenetricarboxylic acid (trimellitic acid), 1,2,5-benzenetricarboxylic acid, 2,5,7-naphthalene tricarboxylic acid, 1,2, 4-naphthalene tricarboxylic acid, 1,2,4-butane tricarboxylic acid, 1,2,5-hexane tricarboxylic acid, 1,3-dicarboxyl-2-methyl-2-methylenecarboxy propane, 1,2, 4-cyclohexane tricarboxylic acid, tetra (methylenecarboxyl)methane, 1,2,7,8-octane tetracarboxylic acid, pyromellitic, enpole trimer acid and the like. These polycarboxylic acids may be anhydride.

Examples of the polyalcohol component include diols such as ethylene glycol, diethylene glycol, triethyleneglycol, 1,2-propylene glycol, 1,3-propylene glycol, 1,4-butanediol, neopentyl lycol, 1,4-butene diol, 1,5-pentanediol, 1,6-hexanediol, 1,4-cyclohexanedimethanol, dipropylene glycol, polyethylene glycol, polypropylene glycol, polytetramethylene glycol and the like; bisphenols such as bisphenol A, hydrogenated bisphenol A, polyoxyethylene bisphenol A, polyoxypropylene bisphenol A and the like; and polyalcohols (triol or more) such as sorbitol, 1,2,3,6-hexanetetrol, 1,4-sorbitan, pentaerythritol, dipentaerythritol, tri-pentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxymethylbenzene and the like.

Examples of colorants used for producing color particles include various pigments.

Examples of black pigment include carbon black, acetylene black, lamp black, aniline black and the like.

Examples of yellow pigment include chrome yellow, zinc yellow, cadmium yellow, yellow iron oxide, mineral fast yellow, nickel titanium yellow, naples yellow, naphthol yellow S, hansa yellow G, hansa yellow 10G, benzidine yellow G, benzidine yellow GR, quinoline yellow lake, permanent yellow NCG, tartrazine lake and the like.

Examples of orange pigment include red chrome yellow, molybdenum orange, permanent orange GTR, pyrazolone orange, Balkan orange, indathrene brilliant orange GK and the like.

Examples of red pigment include colcothar, cadmium red, red lead, mercury sulfide cadmium, permanent red 4R, lithol red, pyrazolone red, watching red calcium salt, lake red D, brilliant carmine 6B, eosin lake, rhodamine lake B, alizarin lake, brilliant carmine 3B and the like.

Examples of purple pigment include manganese purple, fast violet B, methyl violet lake and the like.

Examples of blue pigment include iron blue, cobalt blue, alkali blue lake, victoria blue lake, phthalocyanine blue, metal-free phthalocyanine blue, phthalocyanine blue partial chlorination products, fast sky blue, indanthrene blue BC and the like.

Examples of green pigment include chrome green, chromium oxide, pigment green B, malachite green lake, final yellow green G and the like.

Depending on the colors required for a developer, colorants may be selected as appropriate. The above colorants may be used separately, or two or more kinds thereof may be mixed and used.

A charge control agent used for producing color particles is mixed in a binder resin for the purpose of controlling the toner triboelectric charge, and in accordance with the toner charge polarity, either a charge control agent for positive charge control or one for negative charge control is selected and used.

Examples of a charge control agent for positive charge control include an organic compound having a basic nitrogen atom, for example, basic dye, aminopyrine, pyrimidine compound, polynuclear polyamino compound, amino silane compound and the like; and a filler the surface of which is treated by an organic compound having the basic nitrogen atom listed above.

Examples of a charge control agent for negative charge control include oil-soluble dye such as nigrosine base (CI5045), oil black (CI26150), Bontron S, Spiron Black and the like; a charge control resin such as a styrene-styrene-sulfonic acid copolymer; and a compound containing carboxyl group (for example, alkyl salicylic acid metal chelate etc.), metal complex dyestuff, fatty acid metal soap, resin acid soap, naphthenic acid metal salt and the like.

No particular limitations are made with respect to quantity of charge control agent to be blended. However, with respect to 100 w/t parts of a binder resin, it is preferably, for example, 0.1-10 w/t parts, and more preferably, 0.5-8 w/t parts.

An offset inhibitor used for producing color particles is mixed in a binder resin for the purpose of preventing toner offset at time of image forming (particularly the fusing process). Specific examples include an aliphatic hydrocarbon, aliphatic metal salts, higher fatty acids, fatty esters or partial saponification products thereof, silicone oil, various waxes and the like. Preferably, from among the foregoing, it includes aliphatic hydrocarbon having a weight average molecular mass of roughly 1000-10000. More specifically, a low molecular mass polypropylene, low molecular mass polyethylene, paraffin wax, low molecular mass olefin polymer comprising olefin with at least four carbon atoms, silicone oil, carbana wax and the like. One may be used or two or more kinds may be mixed and used.

No particular limitations are placed with respect to quantity of offset inhibitor to be blended in. However, with respect to 100 w/t parts of a binder resin, such quantity is preferably, for example, 0.1-1 w/t parts, and more preferably, 0.5-8 w/t parts.

In the present invention, nonmagnetic toner is used by causing an additive agent to adhere as necessary to the surface of the above color particles.

While no particular limitations are placed with respect to the additive agent, examples include fine particles (inorganic fine particle) of silica, alumina, titanium oxide and the like, and fine particles (resin fine particle) of an acrylic resin, styrene resin and the like. It is preferable that the silica fine particles be hydrophobic silica fine particles.

The magnetic carrier of the two-component developing agent of the present invention has a resin coating layer on the magnetic particle surface.

While no particular limitations are placed with respect to the magnetic particles constituting the magnetic carrier, examples of such particles include ferrite particles, magnetite particles, iron powder particles and the like. Further, the magnetic carrier may be a so-called magnetic powder dispersion type carrier in which the above exemplified magnetic particles are dispersed in a resin such as an acrylic resin, styrene resin, silicone resin, epoxy resin or the like.

With the view of preventing fine powder toner from adhering on the magnetic carrier surface, the resin coating layer formed on the magnetic particle surface has a critical surface tension of 25 dyn/cm or less, and preferably 22 dyn/cm or less.

While no particular limitations are placed with respect to a material for forming a resin coating layer having a critical surface tension of 25 dyn/cm or less, examples of such materials are silicone resin, fluorocarbon resin, polyamide resin and the like.

While no particular limitations are placed with respect to the saturation magnetization value of the magnetic carrier, it is preferably 35-50 emu/g.

While no particular limitations are placed with respect to the volume resistivity of the magnetic carrier, it is preferably $10^8$-$10^{12}\Omega\cdot$cm.

While no particular limitations are placed with respect to the volume average particle diameter of the magnetic carrier, it is preferably 35-50 μm.

An image forming device for executing image formation using a two-component developing agent of the present invention includes a device comprising, for example, as shown in FIG. 1, a magnetic roller 11, a development roller 12, and a photosensitive drum 15 for retaining an electrostatic latent image on the periphery surface thereof; the two-component developing agent of the present invention is retained on the periphery surface of the magnetic roller 11, the two-component developing agent retained on this magnetic roller 11 and development roller 12 are brought in contact with each other, the nonmagnetic toner in the two-component developing agent electrostatically adheres to the periphery surface of this development roller 12, and the nonmagnetic toner on the development roller 12 is sprayed on the periphery surface of the photosensitive drum 15, thereby causing an image of the electrostatic latent image to appear on the photosensitive drum 15 as a toner image. The two-component developing agent is stored in a housing 14.

The above image forming device is configured so that the development device comprises the housing 14, which can be formed of an appropriate synthetic resin. The end surface of the housing 14 opposite the photosensitive drum 15 has an opening, and the two-component developing agent of the present invention is stored in the housing 14.

In the housing 14, there are disposed stir/transport means 13 for stirring and transporting the stored two-component developing agent, the magnetic roller 11 for magnetically attracting and retaining the two-component developing agent on the periphery surface thereof, and transporting the same, and the development roller 12 disposed with prescribed gaps with respect to the respective periphery surfaces of the magnetic roller 11 and photosensitive drum 15 and to the periphery surface of which only the nonmagnetic toner in the two-component developing agent adheres, each member being rotatably disposed.

The magnetic roller 11 may be a roller, for example, a cylindrical magnetic sleeve comprising a nonmagnetic material such as aluminum, and a static permanent magnet disposed in the magnetic sleeve.

On the surface of the magnetic roller 11, the two-component developing agent is magnetically drawn and retained to form a magnetic brush, thereby transporting the two-component developing agent by the magnetic sleeve rotation.

This magnetic roller 11 is configured so that a predetermined DC bias voltage is applied, for example, from a DC power supply device.

The development roller 12 is constituted by a cylindrical member (sleeve) comprising, for example, a conductive material. It is sufficient if the sleeve material is a uniformly conductive material, and examples include a material covering such as SUS or a material the periphery surface of which is covered with a conductive resin.

This development roller 12 is configured so that a predetermined DC bias voltage is applied from, for example, a DC power supply device, and a predetermined AC bias voltage is superimposed and applied from an AC power supply device.

Means for removing toner not consumed by the development process and remaining on the development roller 12, may be means using removal by a physical method such that toner release means such as a scraper or the like brought in direct contact with the development roller, but no particular limitations are placed with respect thereto and removal means using an electrical method such as applying, for example, a reverse bias voltage, may be used.

While no particular limitations are placed with respect to a photosensitive material of the photosensitive drum 15, examples of such material include a positively charged organic photo conductor (positive OPC), amorphous silicon (a-Si) photo conductor and the like.

When a positive OPC is used, occurrence of ozone or the like can be reduced, and charging can be stabilized. In particular, a positive OPC having a single layer structure is suitable for a durable image forming system because the photosensitive properties thereof change little and image quality can be stabilized even when used over a long term and the film thickness changes. When a positive OPC is used for a durable image forming system, to prevent occurrence of dark spots due to dielectric breakdown when film thickness is reduced, or lowering of sensitivity due to a large film thickness, it is preferable that the positive OPC film thickness be roughly 20-40 μm.

The exposure device for the photoconductive drum 13 may be, for example, a semiconductor laser, LED head and the like.

When a cleaning blade 16 is used as means for removing remaining toner on the periphery surface of the photosensitive drum 15 (toner remaining after transfer), in view of preventing the phenomenon of nonmagnetic toner slipping past through the cleaning blade 16, it is preferable that the average degree of circularity of color particles constituting the nonmagnetic toner of the two-component developing agent be set within the range of 0.925-0.980.

No particular limitations are placed with respect to the cleaning blade 16, and various blades well known as means for removing toner remaining after transfer may be used, such as, for example, an elastic blade and the like.

EMBODIMENTS

The present invention will be explained as follows in further detail with reference to the embodiments and comparative examples. However, no particular limitations are placed with respect thereto.

Embodiment 1 i) Production of Color Particles

Into 100 w/t parts of a binder resin (polyester resin), 4 w/t parts of a colorant (carbon black), 1 w/t part of a positive charge type charge control agent (quaternary ammonium salt), and 5 w/t parts of an offset inhibitor (carbana wax) were mixed by a Henschel Mixer, and fused and kneaded by a biaxial roll mill.

For the above blending components, "MA-100" (product name) manufactured by Mitsubishi Chemical Industries, Ltd. was used as a colorant, and "Bontron P-51" (product name) manufactured by Orient Chemical Industries, Ltd. was used as a positive charge type charge control agent.

Next, the fused and kneaded product thus obtained was cooled by a drum flaker, coarsely ground using a hammer mill, further finely ground, and classified to adjust the particle size, thereby obtaining color particles for black toner. For fine grinding the fused and kneaded product, both a mechanical mill (Turbo Mill) and jet mill were used.

Meanwhile, color particles for color toner (yellow, magenta or cyan) were obtained in a manner identical to that of the color particles for black toner except that, as a colorant, instead of 4 w/t parts of carbon black, 4 w/t parts of yellow pigment (C.I. pigment yellow 180), 4 w/t parts of magenta pigment (C.I. pigment red 122), and 4 w/t parts of cyan pigment (C.I. pigment blue 15:1) were used.

Table 1 shows the containing ratio (wt %) of color particles having a particle diameter within the range of 0.6-2.0 μm with respect to the total number of color particles having a particle diameter within the range of 0.6-400 μm, and the average degree of circularity (dimensionless parameter) of color particles having a particle diameter within the range of 0.6-400 μm.

ii) Production of Nonmagnetic Toner

To each of the color particles obtained in i) above, an additive agent was respectively added, and mixed therein by a Henschel Mixer, thereby obtaining nonmagnetic toner having four colors in total including black toner (Bk), yellow toner (Y), magenta toner (M), and cyan toner (C).

For the above additive agent, silicon oxide fine particles (first particle diameter 12 nm), and titanium oxide fine particles (first particle diameter 44 nm) were used, and the containing ratio of each with respect to the color particles was adjusted so that hydrophobic silica fine particle accounted for 0.6 wt %, and titanium fine particle, 0.8 wt %.

iii) Production of Two-component Developing Agent

The nonmagnetic toner obtained in ii) above and magnetic carrier were stirred and mixed using a ball mill, thereby obtaining a two-component developing agent.

For the magnetic carrier, magnetic particles were used having an average particle diameter of 50 m and saturation magnetization of 40 emu/g on which a coating layer was formed comprising a silicone resin. The critical surface tension of the carrier is as below.

I: Silicone resin coating, critical surface tension 22 dyn/cm

The containing ratio of each with respect to the whole two-component developing agent was adjusted so that nonmagnetic toner accounted for 5 wt %, and magnetic carrier, 95 wt %.

iv) Performance Evaluation

The two-component developing agent obtained in iii) above was used, and for an original document with a coverage of 5%, image formation was carried out on 100,000 sheets consecutively, and the following performance evaluation was made regarding the two-component developing agent. The results are shown in table 2. Further, in a separate test, the two-component developing agent obtained in iii) above was used, and for an original document with a coverage of 0.3%, image formation was carried out on 10,000 sheets consecutively, and the following performance evaluation was made regarding the two-component developing agent. The results are shown in table 3.

For image formation, a hybrid development method image forming device (color printer "FS5016" manufactured by Kyocera Mita Japan Corp.) was used.

Performance evaluation items are as follows.

(a) Image Density

When the original document coverage is 5%, at time of starting image formation and after image formation of 50,000 and 100,000 sheets, image density of the formed image was measured with respect to toner of each color. When the original document coverage is 0.3%, at time of starting image formation and after image formation of 5,000 and 10,000 sheets, image density of the formed image solid portion was measured with respect to toner of each color. Further, in both cases, image density was measured using a reflection density meter (manufactured by Tokyo Denshoku Co., Ltd., product number "TC-6D"), and average values of values measured at 9 locations per sheet having a formed image was taken to be the measured value for the image density.

For toner of all colors, the image density is required to be 1.20 or greater.

(b) Ghost Phenomenon

After an image was formed using a two-component developing agent in which the nonmagnetic toner is the cyan toner (C), the formed image was visually observed three times including time of starting image formation and after image formation of 50,000 and 100,000 sheets, and evaluation was made of occurrence of the ghost phenomenon. The evaluation standard is as follows.

A: No ghost phenomenon observed.

B: A slight ghost phenomenon occurred.

C: A notable ghost phenomenon occurred.

In cases where the nonmagnetic toner was other than cyan toner (C), occurrence of the ghost phenomenon was evaluated in the same manner as in the case of the cyan toner. Because the evaluation results were identical to the case of cyan toner, only the cyan toner results are shown in the following table.

(c) Occurrence of Toner Scatter Phenomenon

Transfer paper used for image formation was observed to evaluate presence of toner staining. Due to the toner scatter phenomenon, toner staining occurs when toner falls from a development device of the image forming device. Further, the above toner scatter occurs when the charge of the color particles has lowered because of lower charging properties of a carrier due to adherence of color particles to the carrier surface.

In the evaluation, A represents a case where toner staining (occurrence of toner scatter phenomenon) was not observed. For cases where toner staining (occurrence of toner scatter phenomenon) occurred, the number of sheets of image formation (repeated number) when toner staining occurred is shown in the following table.

(d) Occurrence of a Void Phenomenon

After an image was formed using a two-component developing agent in which the nonmagnetic toner is the above cyan toner (C), the formed images were observed twice, to evaluate occurrence of a void phenomenon, at time of starting image formation and after the image formation of 100,000 sheets. The evaluation standards are as follows.

A: Void phenomenon was not observed.

B: A slight void ["GHOST" in original] phenomenon occurred.

C: A notable void ["GHOST" in original] phenomenon occurred.

In cases where the nonmagnetic toner was other than cyan toner (C), occurrence of the void phenomenon was evaluated in the same manner as in the case of the cyan toner. Because the evaluation results were identical to the case of cyan toner, only the cyan toner results are shown in the following table.

Embodiments 2 and 3, Comparative Examples 1 and 2

For embodiments 2 and 3 and comparative example 1, nonmagnetic toner identical to that used for example 1 was mixed with the magnetic carrier shown in table 1 to constitute a two-component developing agent. For comparative example 2, the magnetic carrier shown in table 1 was used as a magnetic carrier, and as color particles of the nonmagnetic toner, the color particles shown in table 1 were used, thus constituting a two-component developing agent.

For the developer of embodiments 2 and 3 and comparative examples 1 and 2 thus produced as well, evaluation was performed in the same manner as in example 1.

The above results are shown in tables 2 and 3. Kinds of resin and critical surface tension of a carrier coating resin used for each example and comparative example are as follows.

II: Polyamide resin coating, critical surface tension 18 dyn/cm

III: Fluorocarbon resin coating, critical surface tension 14 dyn/cm

IV: Epoxy resin coating, critical surface tension 46 dyn/cm

TABLE 1

| | Examples | | | Comparative examples | |
|---|---|---|---|---|---|
| | 1 | 2 | 3 | 1 | 2 |
| | Color particles | | | | |
| Bk | 5.60 wt % | 5.60 wt % | 5.60 wt % | 5.60 wt % | 0.62 wt % |
| | 0.950 | 0.950 | 0.950 | 0.950 | 0.913 |
| Y | 6.20 wt % | 6.20 wt % | 6.20 wt % | 6.20 wt % | 0.68 wt % |
| | 0.955 | 0.955 | 0.955 | 0.955 | 0.909 |
| M | 5.90 wt % | 5.90 wt % | 5.90 wt % | 5.90 wt % | 0.61 wt % |
| | 0.948 | 0.948 | 0.948 | 0.948 | 0.920 |
| C | 4.80 wt % | 4.80 wt % | 4.80 wt % | 4.80 wt % | 0.72 wt % |
| | 0.955 | 0.955 | 0.955 | 0.955 | 0.910 |
| | Kinds/critical surface tension of a magnetic carrier (dyn/cm) | | | | |
| | I | II | III | IV | IV |
| | 22 | 18 | 14 | 46 | 46 |

In table 1, the values listed in the row "color particles" indicate, for each of the black toner (Bk), yellow toner (Y), magenta toner (M), and cyan toner (C), in the upper column, the containing ratio (wt %) of the color particles having a particle diameter within the range of 0.6-2.0 μm with respect to the total number of the color particles having a particle diameter within the range of 0.6-400 μm, and in the lower row, the average degree of circularity (dimensionless parameter) of the color particles having a particle diameter within the range of 0.6-400 μm.

TABLE 2

| | | Embodiments | | | Comparative examples | |
|---|---|---|---|---|---|---|
| Coverage [5%] | | 1 | 2 | 3 | 1 | 2 |
| Image density | | | | | | |
| Starting time | Bk | 1.322 | 1.311 | 1.319 | 1.321 | 1.279 |
| | Y | 1.286 | 1.292 | 1.301 | 1.282 | 1.255 |
| | M | 1.314 | 1.306 | 1.312 | 1.302 | 1.271 |
| | C | 1.317 | 1.301 | 1.310 | 1.311 | 1.260 |
| 50,000 sheets | Bk | 1.316 | 1.314 | 1.307 | 1.305 | 1.170 |
| | Y | 1.279 | 1.286 | 1.284 | 1.261 | 1.104 |
| | M | 1.320 | 1.314 | 1.299 | 1.288 | 1.133 |
| | C | 1.315 | 1.297 | 1.302 | 1.292 | 1.154 |
| 100,000 sheets | Bk | 1.312 | 1.307 | 1.318 | 1.296 | 1.124 |
| | Y | 1.266 | 1.274 | 1.279 | 1.265 | 1.046 |
| | M | 1.300 | 1.304 | 1.287 | 1.264 | 1.045 |
| | C | 1.299 | 1.294 | 1.286 | 1.274 | 1.088 |
| Ghost phenomenon | | | | | | |
| Initial | | A | A | A | A | A |
| 50,000 sheets | | A | A | A | A | A |
| 100,000 sheets | | A | A | A | A | B |
| Toner scatter | | | | | | |
| | Bk | A | A | A | A | 4000 |
| | Y | A | A | A | A | 4500 |
| | M | A | A | A | A | 5000 |
| | C | A | A | A | A | 4000 |
| Void | | | | | | |
| Initial | | A | A | A | A | C |
| 100,000 sheets | | A | A | A | A | C |

TABLE 3

| | | Embodiments | | | Comparative examples | |
|---|---|---|---|---|---|---|
| Coverage [0.3%] | | 1 | 2 | 3 | 1 | 2 |
| Image density | | | | | | |
| Starting time | Bk | 1.313 | 1.304 | 1.320 | 1.315 | 1.279 |
| | Y | 1.284 | 1.290 | 1.289 | 1.295 | 1.255 |
| | M | 1.301 | 1.296 | 1.302 | 1.310 | 1.271 |
| | C | 1.293 | 1.305 | 1.315 | 1.301 | 1.260 |
| 50,000 sheets | Bk | 1.288 | 1.289 | 1.272 | 1.204 | 1.134 |
| | Y | 1.269 | 1.263 | 1.257 | 1.163 | 1.043 |
| | M | 1.280 | 1.277 | 1.269 | 1.193 | 1.121 |
| | C | 1.279 | 1.260 | 1.250 | 1.182 | 1.120 |
| 100,000 sheets | Bk | 1.266 | 1.259 | 1.265 | 1.123 | 1.053 |
| | Y | 1.250 | 1.252 | 1.247 | 1.104 | 0.964 |
| | M | 1.271 | 1.268 | 1.260 | 1.094 | 1.017 |
| | C | 1.263 | 1.255 | 1.246 | 1.110 | 0.998 |
| Ghost phenomenon | | | | | | |
| Initial | | A | A | A | A | A |
| 50,000 sheets | | A | A | A | A | C |
| 100,000 sheets | | A | A | A | A | C |
| Toner scatter | | | | | | |
| | Bk | A | A | A | 5000 | 2000 |
| | Y | A | A | A | 4000 | 2500 |
| | M | A | A | A | 5500 | 2000 |
| | C | A | A | A | 4500 | 2000 |
| Void | | | | | | |
| Initial | | A | A | A | A | C |
| 100,000 sheets | | A | A | A | A | C |

As is obvious based on the results shown in tables 2 and 3, with embodiments 1-3 in which the critical surface tension of the magnetic carrier coating layer is set at 25 dyn/cm or less, occurrence of toner scatter was inhibited.

On the other hand, in comparative example 1 in which the critical surface tension of the magnetic carrier coating layer is out of the above range, even though it is an example in which toner identical to that of embodiment 1 was mixed in, the charging properties of the magnetic carrier were lowered due to adherence of toner spent and additive agent. Even though toner scatter did not occur in consecutive printing at a usual coverage of 5%, when the coverage was very low, at 0.3%, and the same nonmagnetic toner and magnetic carrier were stirred in the development device for a long period of time, toner scatter occurred at a relatively early stage.

Further, when a magnetic carrier identical to that of the comparative example 1 and nonmagnetic toner having an average degree of circularity of 0.925 or less were used, due to large unevenness of the nonmagnetic toner surface, toner scatter occurred at an earlier stage than in the case of comparative example 1. In comparative examples 1 and 2, when charging properties of the magnetic carrier were lowered, lowering of the image density together with the number of printing sheets was confirmed, and in comparative example 2, occurrence of a ghost phenomenon was also confirmed.

The present invention is not limited to the above descriptions, and various modifications can be made without departing from the scope of the claims.

What is claimed is:

1. A two-component developing agent used in an image forming device having a magnetic roller, a development roller, a photosensitive drum for retaining an electrostatic latent image on the periphery surface thereof, the two-component developing agent comprising:

nonmagnetic toner; and a magnetic carrier being retained on the magnetic roller periphery surface, the two-component developing agent retained on the magnetic roller and the development roller being brought in contact with each other, the nonmagnetic toner being electrostatically adhered to the development roller periphery surface, the nonmagnetic toner on the development roller is sprayed on the photosensitive drum periphery surface, thereby causing an image of an electrostatic latent image to appear on the photosensitive drum as a toner image, the nonmagnetic toner having color particles and a surface treatment agent, the containing ratio of the color particles having a particle diameter of 2.0 μm or less is 10% or less with respect to the total number, and the average degree of circularity of the color particles being 0.925 or greater, the nonmagnetic toner being used by causing an additive agent to adhere to the surface of the color particles, the magnetic carrier having magnetic particles and a resin coating layer provided on the surface thereof, and the critical surface tension of the resin coating layer being 25 dyn/cm or less.

2. The two-component developing agent according to claim 1, wherein the resin coating layer comprises at least one type of resin selected from the group of a silicone resin, fluorocarbon resin, and polyamide resin.

3. The two-component developing agent according to claim 1, wherein the containing ratio of the color particles based on the particle number is preferably 8% or less.

4. The two-component developing agent according to claim 1, wherein the additive agent is fine particles of silica.

5. The two-component developing agent according to claim 1, wherein the additive agent is fine particles of titanium.

6. An image forming device comprising:

a magnetic roller being configured to retain two-component developing agent on periphery surface of the magnetic roller, the two-component developing agent being nonmagnetic toner and magnetic carrier;

a development roller being brought in contact with the two-component developing agent being retained by the magnetic roller, the nonmagnetic toner being electrostatically adhered to the development roller surface; and a photosensitive drum being configured to retain an electrostatic latent image on the photosensitive drum, the photosensitive drum periphery surface being sprayed the nonmagnetic toner, thereby causing an image of the electrostatic latent image to appear on the photosensitive drum as a toner image, the nonmagnetic toner having color particles and surface treatment agent;

the containing ratio of the color particles having a particle diameter of 2.0 μm or less is 10% or less with respect to the total number, and the average degree of circularity of the color particles being 0.925 or greater, the nonmagnetic toner being used by causing an additive agent to adhere to the surface of the color particle, the magnetic carrier having magnetic particles and a resin coating layer provided on the surface thereof, and the critical surface tension of the resin coating layer being 25 dyn/cm or less.

* * * * *